US009498695B2

(12) United States Patent
Vancho et al.

(10) Patent No.: US 9,498,695 B2
(45) Date of Patent: Nov. 22, 2016

(54) DEVICE AND METHOD TO PRECISELY ISOLATE AND MINIMIZE DIRECTION ERRORS FOR SHORT PUTTS

(71) Applicant: Outside the Leather, LLC, Lake Forest, CA (US)

(72) Inventors: Vincent Michael Vancho, Dove Canyon, CA (US); Timothy Roland Maloney, Trabuco Canyon, CA (US)

(73) Assignee: Outside the Leather, LLC, Lake Forest, CA (US)

( * ) Notice: Subject to any disclaimer, the term of this patent is extended or adjusted under 35 U.S.C. 154(b) by 0 days.

(21) Appl. No.: 14/695,752

(22) Filed: Apr. 24, 2015

(65) Prior Publication Data

US 2015/0231480 A1 Aug. 20, 2015

Related U.S. Application Data

(60) Division of application No. 13/554,495, filed on Jul. 20, 2012, now Pat. No. 9,028,336, which is a continuation of application No. PCT/US2011/033512, filed on Apr. 22, 2011.

(60) Provisional application No. 61/395,728, filed on May 17, 2010.

(51) Int. Cl.

| | |
|---|---|
| ***A63B 69/36*** | (2006.01) |
| ***A63B 67/02*** | (2006.01) |
| ***A63B 71/06*** | (2006.01) |
| *A63B 63/00* | (2006.01) |
| *A63B 57/00* | (2015.01) |

(52) U.S. Cl.

CPC ..... *A63B 69/3691* (2013.01); *A63B 67/02* (2013.01); *A63B 69/3676* (2013.01); *A63B 71/0672* (2013.01); *A63B 57/00* (2013.01); *A63B 63/007* (2013.01); *A63B 69/3641* (2013.01); *A63B 69/3644* (2013.01); *A63B 69/3661* (2013.01); *A63B 2063/001* (2013.01); *A63B 2067/025* (2013.01); *A63B 2071/0694* (2013.01)

(58) Field of Classification Search

CPC ..... A63B 69/3676; A63B 67/02; A63B 2067/025; A63B 69/3644

USPC ..... 473/265, 251–255, 181, 157, 158, 473/162–164, 180, 409

See application file for complete search history.

(56) References Cited

U.S. PATENT DOCUMENTS

| | | | |
|---|---|---|---|
| 1,545,648 | A | 7/1925 | Fletcher |
| 3,944,232 | A | 3/1976 | Tierney |
| 4,344,624 | A | 8/1982 | Laursen |
| 4,368,888 | A | 1/1983 | Ren |
| 4,805,912 | A | 2/1989 | Hickman |
| 4,826,174 | A | 5/1989 | Hoyt |

(Continued)

*Primary Examiner* — Mark Graham

(74) *Attorney, Agent, or Firm* — Myers Bigel, P.A.

(57) ABSTRACT

A device for practicing putting of a golf ball includes: an elongate base with opposed first and second ends and an upper surface; an elongate rail with an upper surface and opposed first and second ends, the rail mounted to the base such that the upper surface of the rail is positioned above and generally parallel with the upper surface of the base; a locating feature positioned adjacent the first end of the rail, the locating feature configured to provide a resting place for a golf ball; and a target area positioned near the second end of the base panel located adjacent the second end of the rail. Such a device can provide immediate and accurate feedback on putting errors committed by the user.

3 Claims, 9 Drawing Sheets

(56) References Cited

U.S. PATENT DOCUMENTS

| | | | |
|---|---|---|---|
| 4,828,267 | A | 5/1989 | Goodrich |
| 5,362,057 | A | 11/1994 | Arima |
| 5,409,231 | A | 4/1995 | Kueng et al. |
| 5,586,941 | A | 12/1996 | Klearman |
| 5,595,543 | A | 1/1997 | Wolk |
| 5,628,694 | A | 5/1997 | O'Connor |
| 5,630,719 | A | 5/1997 | Franklin |
| 5,672,114 | A | 9/1997 | Tu |
| 5,690,557 | A | 11/1997 | Casillas et al. |
| 5,749,789 | A | 5/1998 | Karl |
| 6,458,039 | B1 | 10/2002 | Fontes |
| 6,503,152 | B1 | 1/2003 | Pelz |
| 6,769,995 | B1 | 8/2004 | Rhodes et al. |
| 7,140,971 | B2 | 11/2006 | Trudeau |
| 8,715,099 | B2 | 5/2014 | Dawson et al. |
| 2004/0152529 | A1 | 8/2004 | Chen |
| 2006/0276254 | A1 | 12/2006 | Van Dyke |
| 2009/0176590 | A1 | 7/2009 | Cho |
| 2013/0231199 | A1 | 9/2013 | Stockton et al. |

DEVICE AND METHOD TO PRECISELY ISOLATE AND MINIMIZE DIRECTION ERRORS FOR SHORT PUTTS

RELATED U.S. APPLICATION DATA

This application is a divisional application of and claims priority to U.S. patent application Ser. No. 13/554,495, filed Jul. 20, 2012, which claims priority from International Application No. PCT/US2011/033512, filed Apr. 22, 2011, which claims priority from U.S. Provisional Patent Application No. 61/395,728, filed May 17, 2010, the disclosure of each of which is hereby incorporated herein in its entirety.

FIELD OF THE INVENTION

This is invention is directed generally to sports training devices, and more particularly to golf training devices.

BACKGROUND OF THE INVENTION

Persons who play golf typically want to improve at all aspects of the game. One key area of both recreational and tournament play is making putts of short lengths. In principle, a short putt is anything that is just outside of the distance that is required for a golf ball at rest to just fall into the cup. But in a more practical sense, and to those who are familiar with the game of golf, a short putt can be considered to be that distance which is just beyond the length of measurement between the putter head and the grip of a putter. In golfing parlance it's "outside the leather" of the golf putter. For standard putters this is a distance of about 24 inches. In friendly competition, when a ball is "outside the leather" it is deemed to be fax enough away to require the putt to be made; in contrast, if the ball is "inside the leather" it can be considered "holed" and the putt need not to be made.

These "outside the leather" putts are considered to be the most difficult, because they are usually required by a fellow competitor against a player who is favored to win a hole or match. So the putt has added difficulty because it is often made under serious duress of competition. Unlike a putt of great length where it is expected to just get close, the short putt is expected to be made, potentially adding even more stress to the putt.

Making short putts is a crucial area of play, because the short putt encompasses so many situations within the game. By way of example, if a player wants to make a par on a particular hole but misses a green, he must get his ball "up and down" in order to do so, meaning that he now has to pitch or chip his ball as close to the hole as possible (preferably into the hole, but the probability of doing so is very low). Being proficient with short putts can allow the player to play the chip or pitch shot with less mental strain, as he does not feel compelled to hit the greenside shot as close to the hole, thereby making the shot easier to hit. In another example, when a player actually hits the green in regulation, many times the approach shot does not ultimately finish close to the hole, so the player is forced to make a long "two putt". A common teaching technique, known to those familiar with golf, is for the player, during the first putt, to pretend the hole is six feet in diameter in order to take pressure off the putt. However, even if successful, such a first putt can leave the player with a final putt that may be as long as 36 inches. Unless the player is proficient in making this short putt, the pressure on the first putt is never really eliminated, and thus the technique does not work. Moreover, in tournament stroke play, the hole is never completed until the putt is holed, irrespective of how short it is, and in match play, when the match gets down to the final holes it is virtually guaranteed that a player will have to make short putts to win a hole or a match.

Putting stroke errors affect a putt's speed and/or direction. For putts of short length, it is recognized by those familiar with golf that if a short putt is missed, it is generally associated more with errors of direction than speed. Being able to precisely putt to a given aim point is paramount to reliably make short putts. If a person has the capability to putt very precisely, his chance of holing short putts is greater than that of a person who cannot putt precisely. By way of example, if a person placed a golf ball twenty-four inches from a hole and aimed at the exact center of the hole, but had sufficient putting stroke errors such that the average directional variance associated with the struck ball was plus or minus 5 degrees, the putt, on average, would miss the hole. However, in that same situation, if a person had reduced putt stroke errors such that the average directional variance was plus or minus 1 degree, the person could aim as much as 1.7 inches on either side of the center of the cup and the ball would still fall into the cup. This would greatly improve the chances of not only holing level putts, but would work to improve the chances of putts that break right or left due to a green with sloping terrain.

Additionally, once putting precision goes up, a golfer can have greater allowance for the speed, because it is also well known by those knowledgeable in golf that a putt that strikes the center of the hole will have a greater chance of going in even if the putt is hit excessively hard, whereas a ball with the same velocity hitting the edges of the hole may have a tendency to miss due to the centrifugal force that is applied from the rounded edges of the cup.

Putting stroke errors that affect direction are either related to (a) the face of the putter not being perpendicular to the direction of the intended line of putt, (b) the stroke path of the putter not being on the intended line of putt, and/or to a lesser extent (c) the putter head not contacting the ball at the center of mass of the putter. All three errors can combine at impact and result in propelling the ball in the intended direction with some level of variance to that direction. An object in putting is to minimize this directional variance—or, said another way, to maximize putting precision—by reducing or eliminating the three stroke errors mentioned above. Current science related to putting suggests that club face angle can be responsible for as much as 80-90 percent of missed putts, whereas stroke path can be responsible for 10-20 percent of missed putts (not hitting the ball at the putter head center of mass is a distant third).

Instructional literature regarding putting often emphasizes the importance of striking a putt such that topspin is imparted on the ball. Properly applied topspin will send the ball toward the cup rolling end over end. Sidespin, however, which is applied when a golfer has a stoke path that cuts across the intended line of putt, will cause the ball to drift off of the intended line. The issue with any turf (in addition to potential irregularities of the surface) is that turf tends to dampen side spin imparted to the golf ball at impact, by creating drag forces that cause the ball to roll end over end. Thus, in an uncontrolled system (e.g., putting on a typical practice green), turf drag can cause erroneous outcomes. For example, if a golfer hits a putt in such a way that the stroke path imparts spin which would otherwise cause the ball to drift to the left of the cup, and the face of the putter points inside the left edge of the cup, the ball should miss the cup on the left; however, the turf may quickly dissipate the side spin and thereby eliminate the left drift and result in a holed putt just inside the left side of the cup. Although holing the putt is the desired result, the golfer learns little to nothing about the putt stoke errors because he sees the end result as a holed putt. Therefore, the golfer may not adjust his putting stroke to eliminate the errors associated with the stroke path and club face angle.

Total error of a putt can be considered to be the sum of the putt stroke error (built into the stroke up to the point of striking the ball with the putter) plus variances due to turf influence during the rolling phase of the putt. The turf or rolling variance should be eliminated or minimized in order for a golfer to have a way to absolutely isolate and subsequently reduce errors of the putting stroke, thereby decreasing directional variance and increasing putting stroke precision.

In view of the foregoing, it may be desirable to provide a putting practice device and/or method that can improve the putting of a player, particularly short putting, and/or that can provide feedback on putting in a controlled, repeatable environment.

SUMMARY OF THE INVENTION

As a first aspect, embodiments of the present invention are directed to a device for practicing putting of a golf ball. The device comprises: an elongate base with opposed first and second ends and an upper surface; an elongate rail with an upper surface and opposed first and second ends, the rail mounted to the base such that the upper surface of the rail is positioned above and generally parallel with the upper surface of the base; a locating feature positioned adjacent the first end of the rail, the locating feature configured to provide a resting place for a golf ball; and a target area positioned near the second end of the base panel located adjacent the second end of the rail. Such a device can provide immediate and accurate feedback on putting errors committed by the user.

As a second aspect, embodiments of the present invention are directed to a device for practicing putting of a golf ball, comprising: an elongate base with opposed first and second ends and an upper surface; a first rail with a first putting surface having opposed first and second ends, the first rail being mountable to the base such that the first putting surface is positioned above and generally parallel with the upper surface of the base, the first rail having a first width; a second rail with a second putting surface having opposed first and second ends, the second rail being mountable to the base such that the second putting surface is positioned above and generally parallel with the upper surface of the base, the second rail having a second width that differs from the first width; and a target area positioned near the second end of the base panel located and adjacent the second end of the rail.

As a third aspect, embodiments of the present invention are directed to A method of practicing putting of a golf ball, comprising the steps of: (a) providing a putting device comprising: an elongate base with opposed first and second ends and an upper surface; an elongate rail with a putting surface and opposed first and second ends, the rail mounted to the base such that the putting surface of the rail is positioned above and generally parallel with the upper surface of the base; a locating feature positioned adjacent the first end of the rail, the locating feature configured to provide a resting place for a golf ball; and a target area positioned near the second end of the base located adjacent the second end of the rail; (b) positioning a golf ball on the locating feature; and (c) putting the golf ball on the putting surface of the rail toward the target area.

DETAILED DESCRIPTION OF EMBODIMENTS OF THE INVENTION

Figure 1:
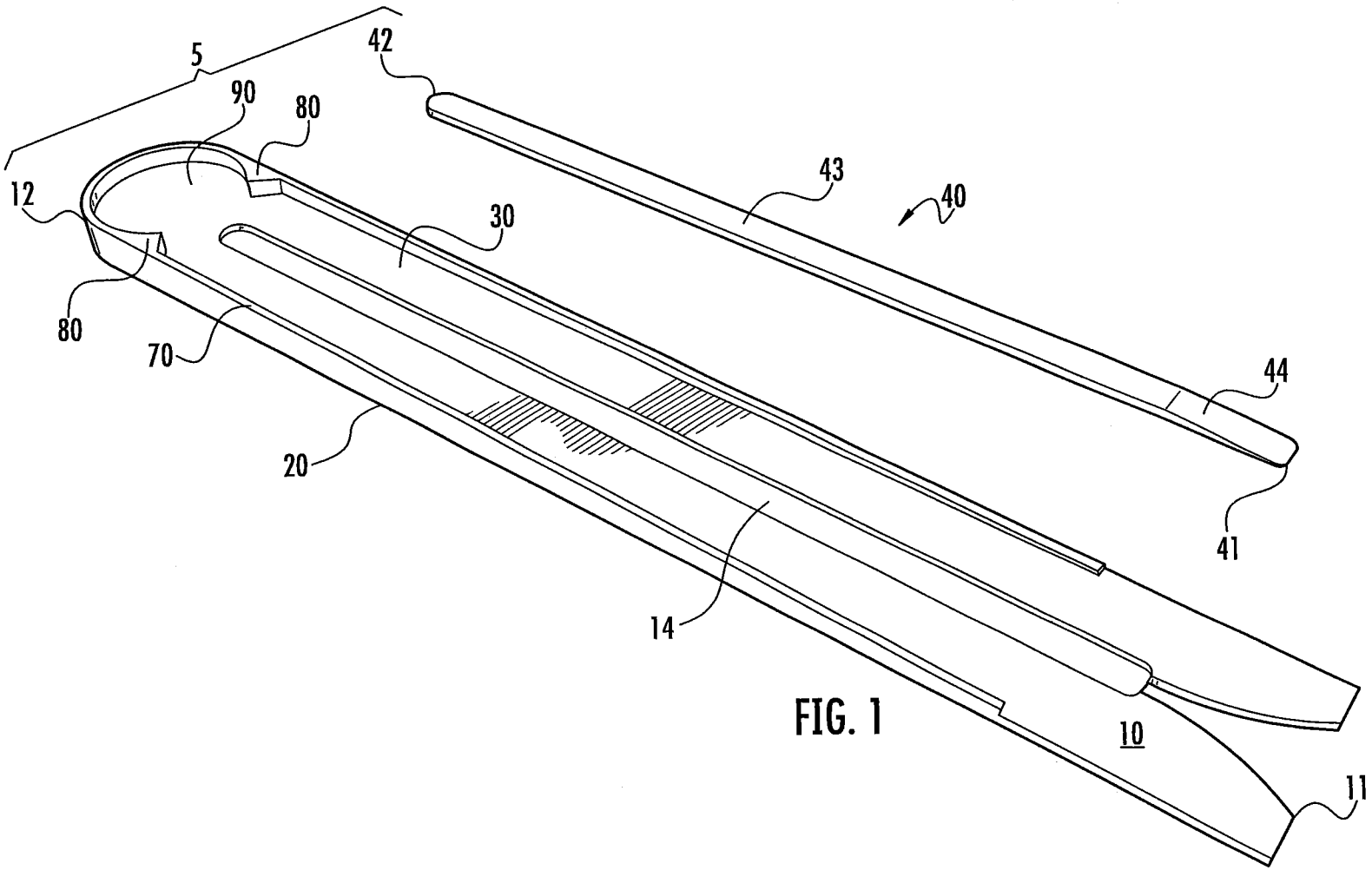
FIG. 1 is an exploded perspective view of a putting practice device according to embodiments of the present invention, with a rail removed and placed next to the base panel.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the figures, a putting practice device, designated broadly at 5, is shown in FIGS. 1-4. The device 5 includes an elongate base 10 and a detachable elongate rail 40. These components are described in greater detail below.

The base 10 is illustrated as formed as a unitary member (typically wood or plastic). The base 10 has a horizontal flat bottom surface 20 and an upper surface 30 that runs much of the length of the base 10. The upper surface 30 is typically inclined (e.g., approximately 0.5-3.0 degrees) upwardly from the near end 11 to the far end 12 relative to the bottom surface 20. The base 10 includes a channel 14 that extends much of the length of the base 10. In some embodiments, the base 10 is about 24-60 inches in length and about 3-6 inches in width, and varies in thickness from about 0.1-0.3 inch at the near end 11 to 0.5-1.5 inches at the far end 12. The channel 14 may be between about 0.060 and 0.250 inch in depth, and may be sized in length and width to receive the rail 40 as described below.

Figure 3:
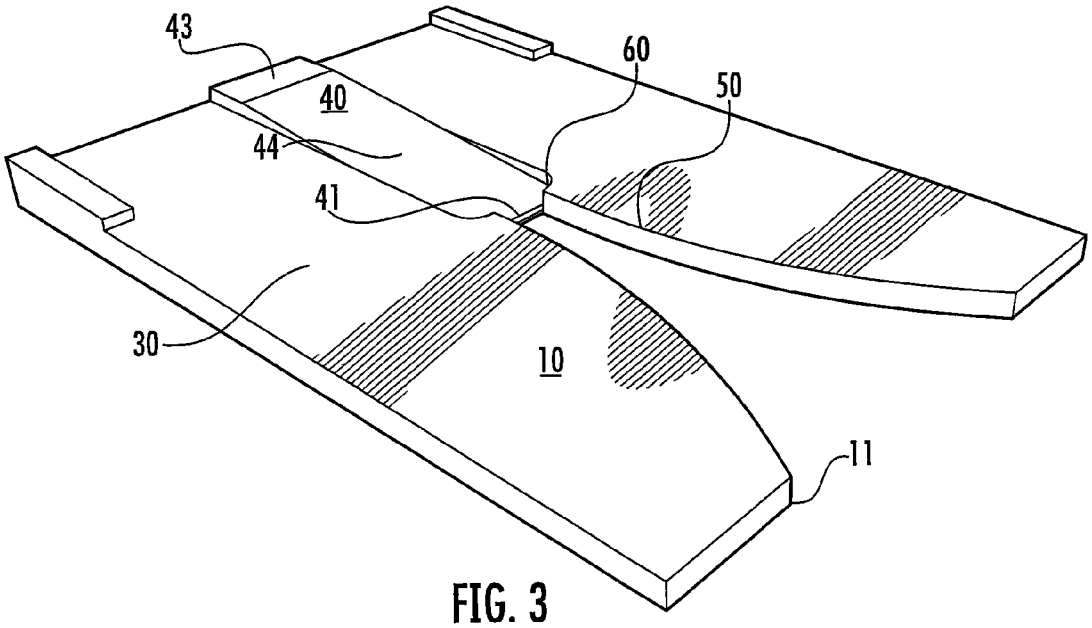
FIG. 3 is a perspective view of the inlet of the device of FIG. 1.

At the near end 11 of the base 10, an open-ended tapered inlet 50 extends toward and merges with the channel 14 (see FIG. 3). At its narrowest point, the inlet 50 is narrower than the channel 14. At its widest point at the near end 11, the inlet 50 is typically between about 2-4 inches in width, and is greater in width than a golf ball. At its opposite, tapered end, the inlet 50 is typically between about 0.375-0.600 inch. In some embodiments, the area around the inlet 50 may include visual indicia (e.g., one or more straight lines) that indicate the proper swing path for the putter.

The base 10 also includes a perimeter fence 70 which comprises a raised wall extending upwardly from the upper surface 30 and mounted around the perimeter of the base 10. The fence 70 is typically approximately 0.125-0.5 inch wide and 0.050-0.75 inch in height. In some embodiments the fence 70 increases in height toward the far end 12 of the base 10, with a height of approximately 0.375 inches at the rear end 12 being typical. The fence 70 ordinarily bounds a major portion of the periphery of the base 10, including the side edges and the target area 90 (see below).

Figure 4:
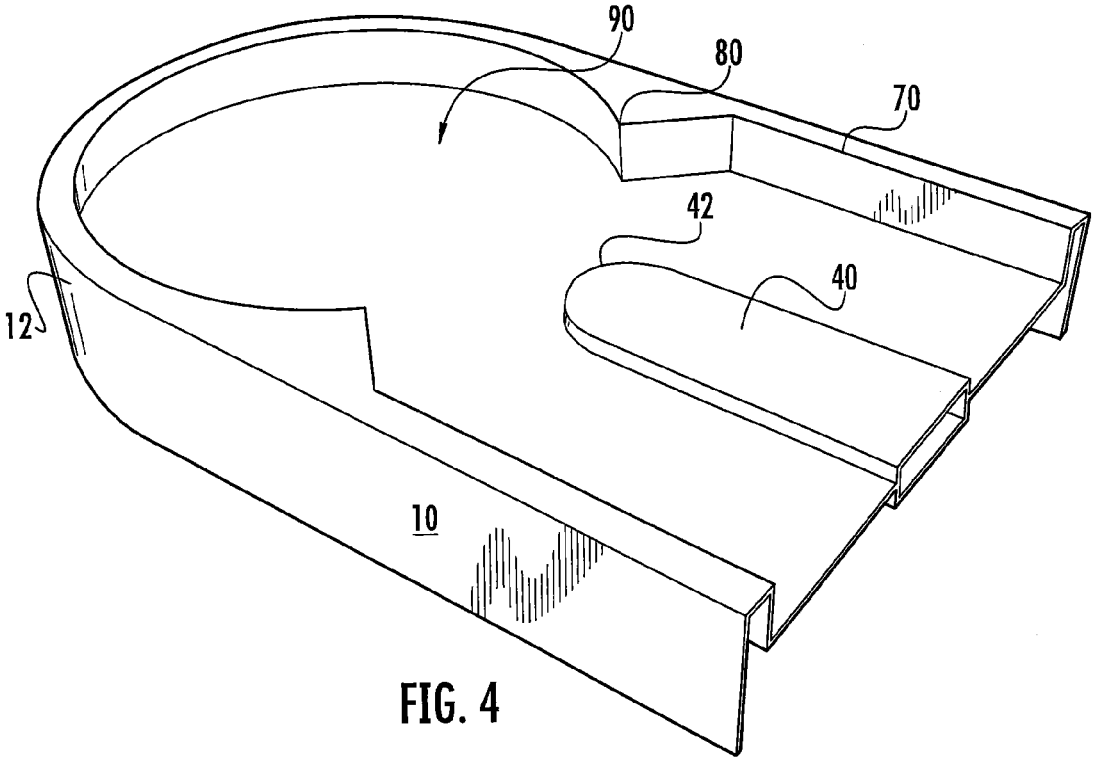
FIG. 4 is a perspective view of the target area of the device of FIG. 1.

A target area 90 is positioned at the far end 12 of the base 10 (see FIG. 4). The target area 90 is typically sized to approximately simulate the size of a golf hole. In some embodiments, the target area 90 may include some visual indicia, such as a circle that simulates a golf hole. Alternatively, the target area 90 may include interchangeable inserts, such as a product logo, the name of a golf club or resort, or the like.

The target area 90 is guarded by two wedge-shaped gates 80 that extend inwardly from the fence 70 and reduce the width of entry into the target area 90. The gates 80 are typically the same height as the fence 70.

Figure 2:
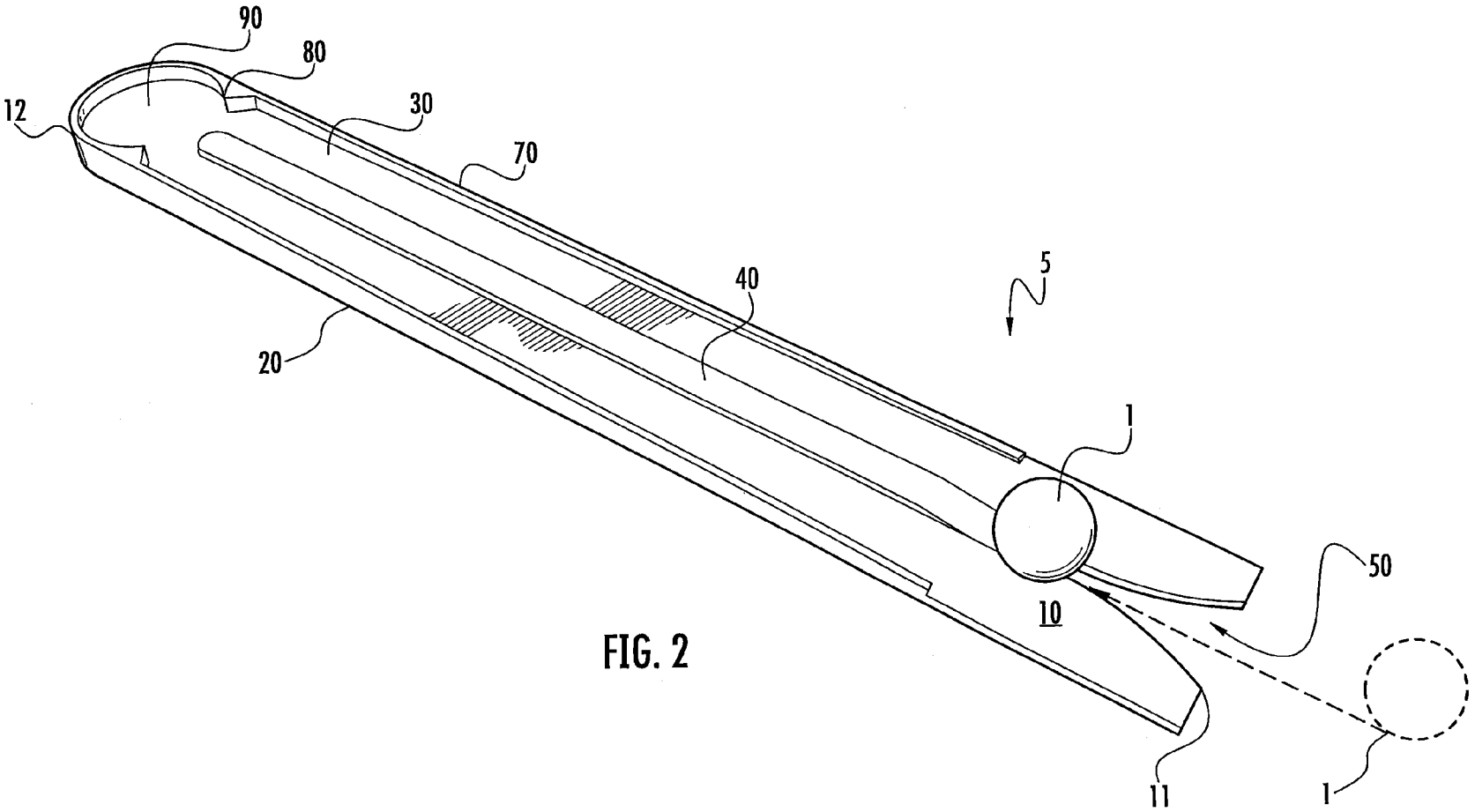
FIG. 2 is a perspective view of the putting device of FIG. 1, with a golf ball shown in the waiting position and in place in the locator feature.

FIG. 1 also illustrates the rail 40. The rail 40 includes a near end 41 and a far end 42. A planar upper surface 43 extends from the far end 42 to an inclined section 44 at the near end 41. As can be seen in FIG. 2, the rail 40 is received in the channel 14 of the base 10. In one embodiment, the rail 40 is between about 16-40 inches long, between about 0.25-2.0 inches wide, and between about 0.06-0.5 inch thick.

The rail 40 can be formed of any number of materials, including plastic, metal, wood or the like. In some embodiments, the upper surface 43 of the rail 40 is very smooth. The smooth finish reduces friction between the golf ball and the insert upper surface 43. Because the golf ball is being propelled forward, surface friction, which would cause the ball to drag opposite the direction of movement and impart forward spin on the golf ball that would reduce or eliminate any side spin, is minimized.

Referring now to FIG. 2, therein the base 10 and rail 40 are assembled to create the device 5. As can be seen in FIG. 2, the rail 40 is inserted into and nested within the channel 14 of the base 10, with the near end 41 of the rail 40 being positioned adjacent the near end 11 of the base 10 (typically positioned about 2-5 inches away), and the far end 42 of the rail 40 positioned adjacent the far end 12 of the base 10. As can be seen in FIGS. 2 and 5, the upper surface 43 of the rail 40 extends above the upper surface 30 of the base 10 and is generally parallel thereto; in some embodiments, the upper surface 43 extends between about 0.050 and 0.250 inch above the upper surface 30. However, as can be seen in FIG. 3, the lower portion of the inclined section 44 dips below the upper surface 30 (typically approximately 1/32-1/8 inch). Thus, the end of the inclined section 44 and the near end of the channel 14 form a depression that serves as a locating feature 60 for a golf ball. In some embodiments, the locating feature 60 is between about 24-54 inches from the target area 90.

Referring still to FIG. 2, use of the device is illustrated therein. A golf ball 1 is shown in broken line in a waiting position in the inlet 50, and being moved to a starting position in the locating feature 60 ready for putting (in solid line). In use, a golfer places the golf ball 1 in the inlet 50 such that it can be rolled into a consistent, secure, starting position in the locating feature 60. Because the inclined section 44 of the rail 40 is angled slightly with respect to the locating feature 60, the ball 1 is accurately held in a controlled, repeatable location in the device 10. In some instances, the golfer can position the golf ball 1 by simply using a putter to sweep or drag the golf ball 1 up the inlet 50, which lifts the ball 1 onto the upper surface 30 and deposits it at the locating feature 60. This technique can enable the golfer to deposit the ball 1 in the locating feature 60 without having to bend over.

Once the golf ball 1 is in the starting position, the golfer attempts to putt the golf ball with sufficient accuracy and speed so that it travels up and along the upper surface 43 of the rail 40 and reaches the far end 42 of the rail 40 and, without hitting the hole gates 80, ends up in the target area 90.

Because the upper surface 43 of the rail 40 is above the upper surface 30 of the base 10, the user will be able to tell when the golf ball 1 veers from the intended putting line, because the ball 1 will fall off of the rail 40, make a sound and travel sideways on the upper surface 30 of the base 10 toward the fence 70. If the ball 1 is hit with sufficient error that it would otherwise go travel off of the upper surface 30, the fence 70 acts to capture the ball 1. Whether the ball 1 is putted successfully to the target area 90 or falls off of the rail 40 before reaching the far end 42, the fence 70 will maintain the ball 1 on the upper surface 30. Because the upper surface 30 is angled slightly downwardly toward the near end 11, the golf ball 1 rolls back down the upper surface 30 toward the near end 11 of the base 10 and out of the inlet 50. The ball 1 can then be easily repositioned on the locator feature 60 to repeat the process.

Putts which are improperly hit tend to be associated with two types of putting stroke errors. The first type of error is major, and is caused when the putter face is not facing the hole at impact. The second type of error tends to be minor, and is caused when the putt swing path is not on the target line. Unless a putt is hit with sufficient precision to travel up the entire length of the rail 40, the ball 1 will fall off of the rail 40 on one side or the other. Once a ball 1 falls off of the rail 40, it is immediately clear that the putt was incorrectly hit, and the area where it falls off the rail 40 can provide immediate feedback related to the golf stroke error. Putts that quickly fall off of the rail 40 will likely be errors resulting from bad face angles. Putts that fall near the end of the rail 40 will tend to be putts where a combination of face angle and swing path both play a part (often resulting in side spin). It can be important that this sidespin is allowed to continue so the ball 1 can fall off of the rail 40 and be seen by the user.

When intervening turf has texture and is not smooth, sidespin is replaced with topspin due to the frictional drag caused by the ball-turf interface. One potential advantage of the present invention is the reduction and/or elimination of the intervening turf drag and corresponding isolation of sidespin, so that if sidespin is contributing to putting stoke error the effect will continue as far along as possible into the putt. This will increase the chances that the ball 1 will fall off the rail 40 even at the farthest point of the rail 40.

The thickness of the near end 11 of the base 10 is typically approximately 0.1-0.3 inch. This is a thickness that is generally low enough to avoid interfering with the position of the putter with respect to the floor or ground. If this thickness is too high—for example, using an extreme value of one inch—the putter height would be outside of a typical putting condition where the putter and ball rest on the ground level with the golfer's feet. Ideally, this thickness is as small as possible to make the feeling as close as possible to natural putting. However, a thinner dimension of the base 10 may negatively impact the strength and durability of the device 10. Thus, materials for the base 10 should be chosen accordingly.

In the illustrated embodiment, the fence 70 is shown to have a height of 0.250 inches near the near end 41 of the rail 40, which increases to 0.375 inches behind the target area 90. When a ball 1 rolls off of the rear end 42 of the rail 40, it typically has sufficient energy to continue to travel to the rear end of the fence 70. The height of the fence 70 may be selected such that, in order for the ball 1 to scale the fence 70 at this point, the ball 1 must have sufficient energy that it would likely "skip over" an actual golf hole. Therefore, when using the device 10, a golfer can learn to putt the ball with sufficient firmness to reach the hole, but not so hard as to skip over the hole on a typical green.

Those of skill in this art will appreciate that a number of variations to the device 10 may be employed. For example, the dimensions of components set forth above may vary in a number of different ways. Further alternative embodiments may include increasing or decreasing the diameter of the target area 90 and/or omitting the gates 80 or making them different in form and function.

Alternative embodiments of the configuration of the near end 11 of the base 10 may include slots or v-grooves that are used to urge or direct the ball 1 to the locating feature 60. With respect to the locating feature 60, a pair of slightly proud mounds in the base upper surface 30 may be used to hold the ball in position. Further provide positioning and retaining variations may also be employed. Also, swing correction devices, such as devices that direct or influence the putter head as the stroke is made, may be attached or affixed to this area of the device 5 to further assist the user in honing his/her stroke.

In still further alternative embodiments, the fence 70 at the far end 12 of the base 10 may be greater or lesser than 0.375 inches in height to match the energy requirement threshold of a ball to stay within the target area 90 due to variations in the hardness of the golf ball 1 and different surface cover materials. In some embodiments, the fence 70 may be adjustable in height to adapt to the desired speed of the putt.

In summary, the device 5 may be employed such that that a user hits a putt up the full length of the rail 40 such that it reaches the rail far end 42 and falls off onto the target area 90. If the putting line is incorrect, or if too much side spin is applied to the golf ball 1, the ball 1 will fall off the rail 40 before it reaches the target area 90. However, once the user achieves consistency in putting the entire length of a one-inch rail 40, the user has reduced his putting variance to approximately plus or minus 1 degree based on 27-inch rail 40. This improvement in putting precision may allow the golfer to consistently hole a level 9.6 foot putt on a typical putting green.

At this point, unless the user has a way to increase the putting difficulty, the user cannot improve his putting stroke by reducing putting stroke variance. The present invention may also, in some embodiments, provide a capability for the user to continue to increase putting precision. This may be achieved by replacing the standard rail 40 with rails of increasing difficulty.

Figure 5A:
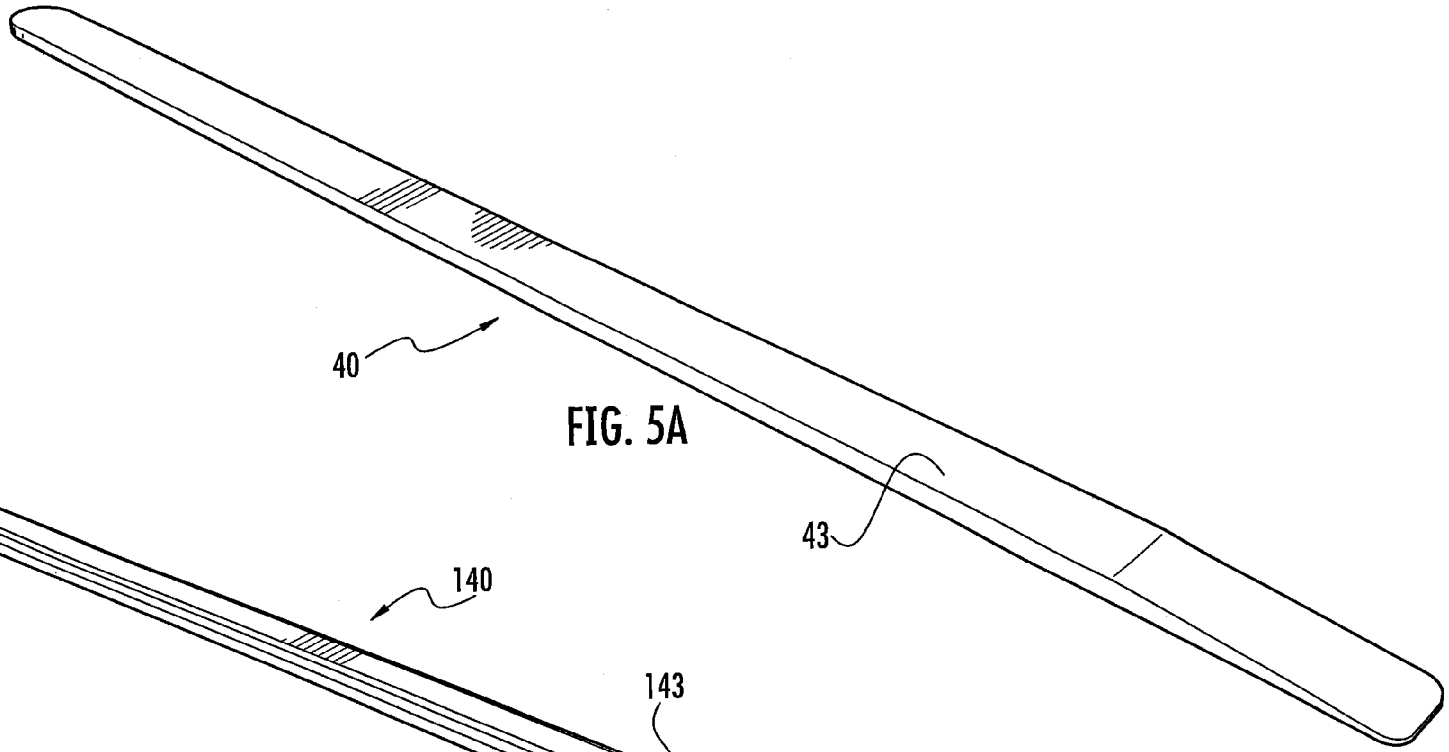
FIG. 5A is a perspective view of a rail for the device of FIG. 1.
Figure 5B:
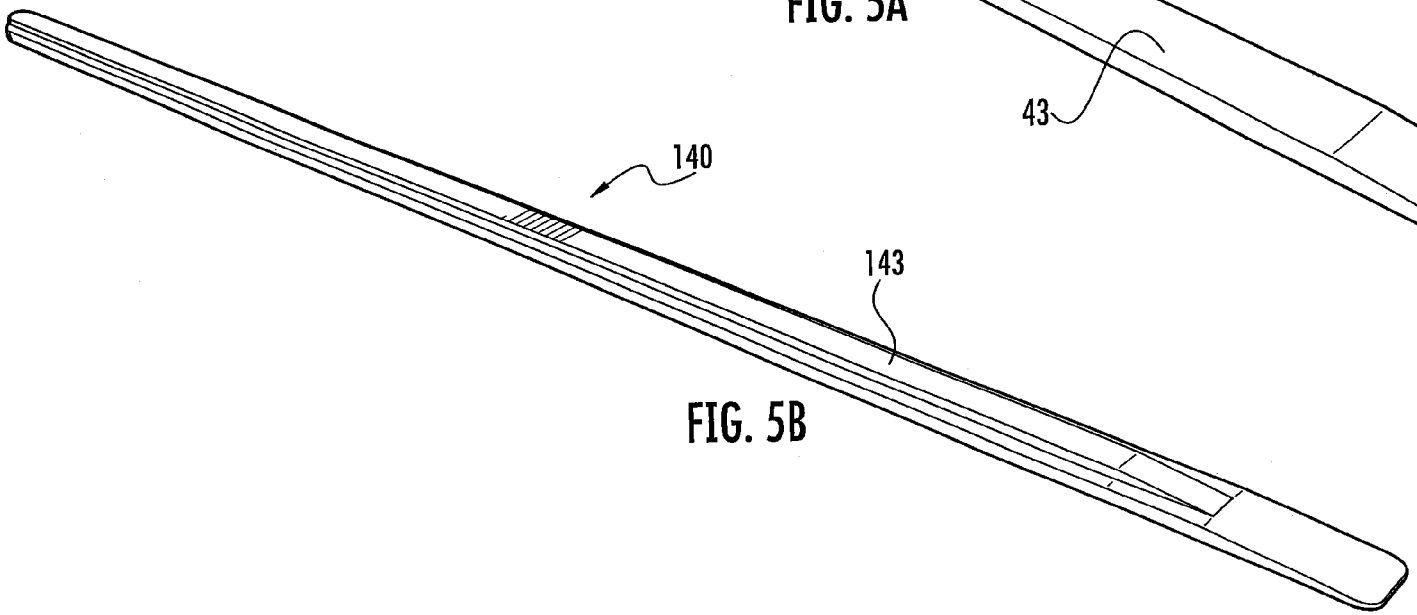
FIG. 5B is a perspective view of an alternative embodiment of a rail for the device of FIG. 1.

FIG. 5A is a perspective view of the rail 40 in comparison to a second rail 140 shown in FIG. 5B. Both rails 40, 140 may have an identical overall length and identical starting ends; however, the second rail 140 has a decreased upper surface 143 on which the golf ball 1 can roll.

Figure 7:
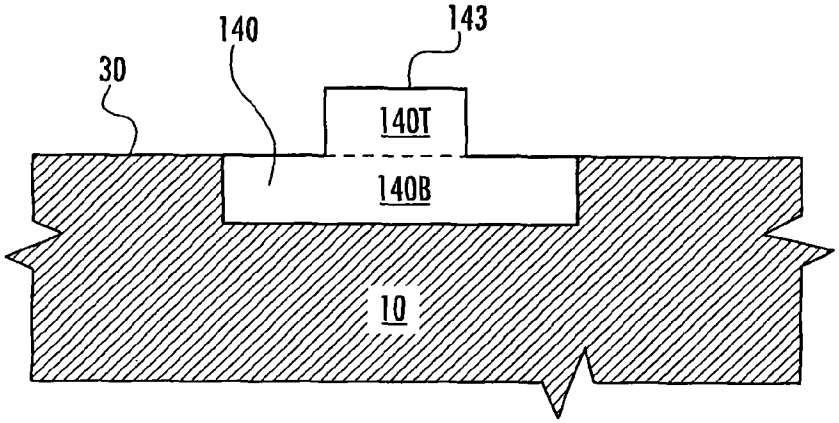
FIG. 7 is a cross-section of the rail of FIG. 5B.
Figure 6:
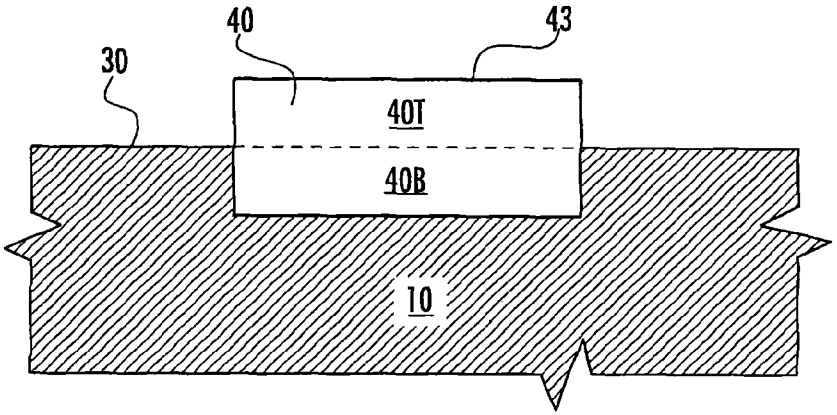
FIG. 6 is a cross-section of the rail of FIG. 5A.

FIG. 6 shows a cross-section midway through rail 40. In FIG. 6 the rail 40 is divided into a top portion 40T and a bottom portion 40B, where the delineation between the two portions 40T, 40B is a horizontal plane which is at the same level as the upper surface 30 of the base 10. In contrast, FIG. 7 presents a reduced width rail 140 in which the top portion 140T is reduced in size and has the shape of a rectangle. The rail upper surface 143 may be smooth and flat, but because it presents a narrower putting surface, it will require more precise putting to achieve a successful putt the length of the entire rail 140. Like the bottom portion 40B, the rail bottom portion 140B has the same cross-section as the channel 14. In some embodiments, the cross-section of the rail 140 may be generally trapezoidal (similar to that of the rail 340 discussed below), with flat or curved surfaces between the upper surface 143 and the side walls of the rail.

Intuitively it can be seen that the difficulty level of putting a golf ball along the reduced width rail 140 is more difficult than putting along the standard rail 40. By narrowing the rail upper surface, not only must the stroke direction be along the target line, but the rail becomes very sensitive to any side spin that is imparted on the golf ball. Directional accuracy must be very high and side spin must be very low. Indeed, if a rail 140 with an upper surface 143 of 0.5 inches were used and perfected in practice by the golfer, he/she would have a putting stroke variance of 0.5 percent and would be able to consistently hole a level putt of 18.2 feet. By increasing the putting precision requirement a golfer is forced to reduce stoke variance considerably in order to make a successful putt.

Figure 10A:
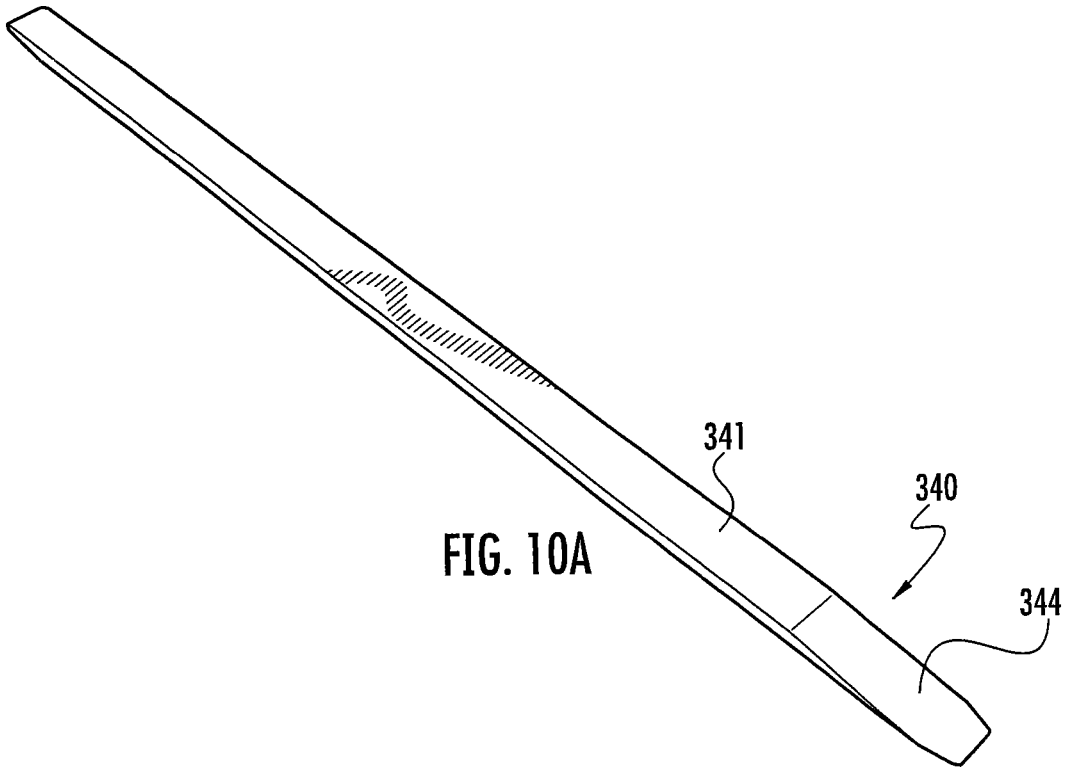
FIGS. 10A and 10B are perspective top and bottom views, respectively, of a rail according to alternative embodiments of the invention.
Figure 10B:
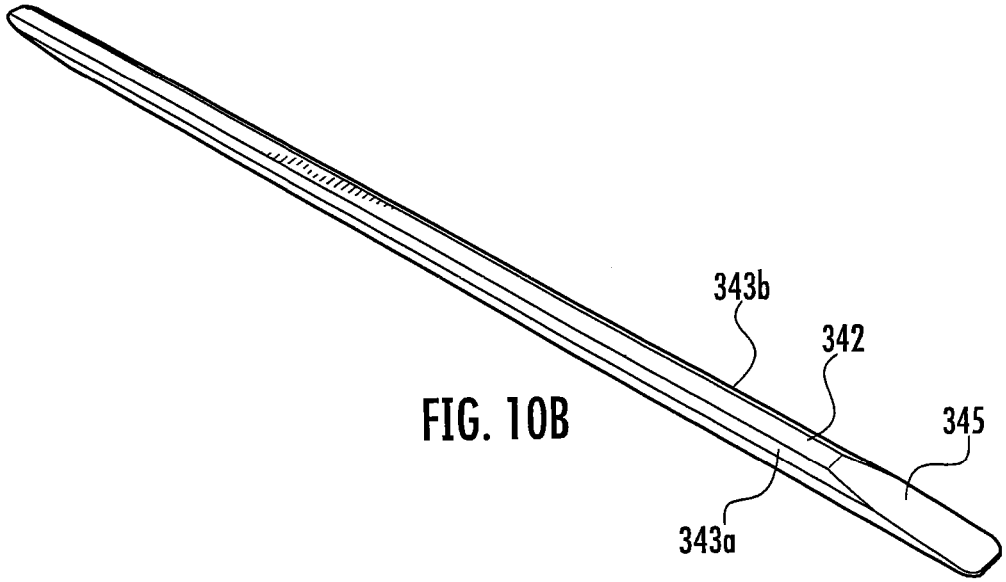

An alternative embodiment of a rail, designated broadly at 340, is shown in FIGS. 10A and 10B. The rail 340 has a flat surface 341 that extends the full width of the rail 340 and an opposed flat surface 342 that extends only partially the width of the rail 340 (in this embodiment, the surface 342 extends half of the width of the rail 340). Canted faces 343*a*, 343*b* extend between the edges of the surface 342 and the sides of the rail 340, such that in cross-section the rail 340 is an irregular hexagon. At one end the rail 340 has an inclined surface 344 that merges with the surface 341, and at the opposite the rail 340 has an inclined surface 345 that merges with the surface 342, such that the inclined surfaces 344, 345 are at opposite ends and on opposite sides of the rail 340.

The rail 340 can be substituted for either of the rails 40, 140 in the device 5 as a co-existent single rail. If a less precise putting device is desired, the rail 340 can be oriented in the channel 14 with the surface 341 facing upward (as in FIG. 10A), and the inclined surface 344 adjacent the near end 11 of the base 10. If a more precise putting device is desired, the rail 340 can be inverted such that the surface 342 faces upwardly and rotated such that the inclined surface 345 is adjacent the near end 11 of the base 10 (as in FIG. 10B). Thus, the rail 340 can provide the device 10 with different putting precision requirements with a single rail.

In alternative embodiments, the cross-section of the rail(s) may take many shapes for people of varying putting levels. For example, the upper surface of the rail could be convex or dome-shaped providing nearly a point contact with the golf ball for a very difficult challenge. Conversely, the upper surface of the rail could be a U-shaped channel, such that nearly everyone would have 100 percent success in putting the entire length of the rail. This would allow people learning the game of golf, such as children, to have a device that offers immediate rewards relative to the amount of skill level. For people who are not used to putting, simply standing in a putting position requires certain muscles that need to be developed, and having a device that virtually guarantees the making of a putt (or a high percentage of putts) may provide some self-esteem to continue practicing. Additionally, rails may be covered with textured surfaces which simulate various speeds of natural golf putting greens. Although such surfaces would add variance to the rolling putt, it may be useful to one who has reduce stroke variance to an absolute minimum to see how various surfaces increase overall putting variance.

In some embodiments, the base and rail(s) are separate components; however, in an alternative embodiment both pieces may be made as one unitary device. For example, a solid piece of wood may be milled to include the insert as an integral part of the base. In this case there would be only one level of precision putting available. However, a golfer may prefer to have two separate integrated devices—one with a one inch insert milled into the base, and one with a one half inch insert integrated into the base, for example. This would prevent the inserts from being lost or accidentally broken if they are stored separately. The unified device is not limited to wood, as any plastic or metal insert can be milled into the main base to form a unitary device. In the case of plastic, the insert and base can be injection molded to form a unitary device.

Figure 8A:
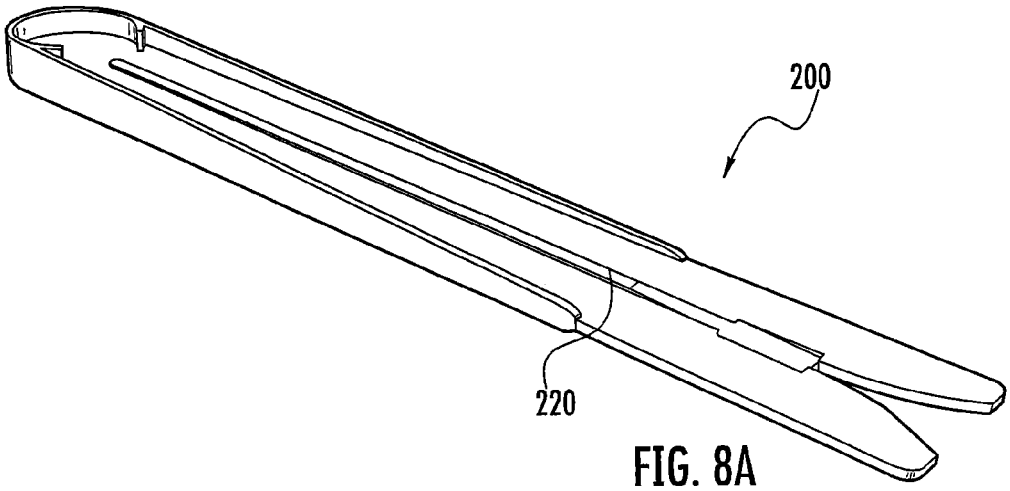
FIG. 8A is a top perspective view of a device according to alternative embodiments of the present invention.
Figure 8B:
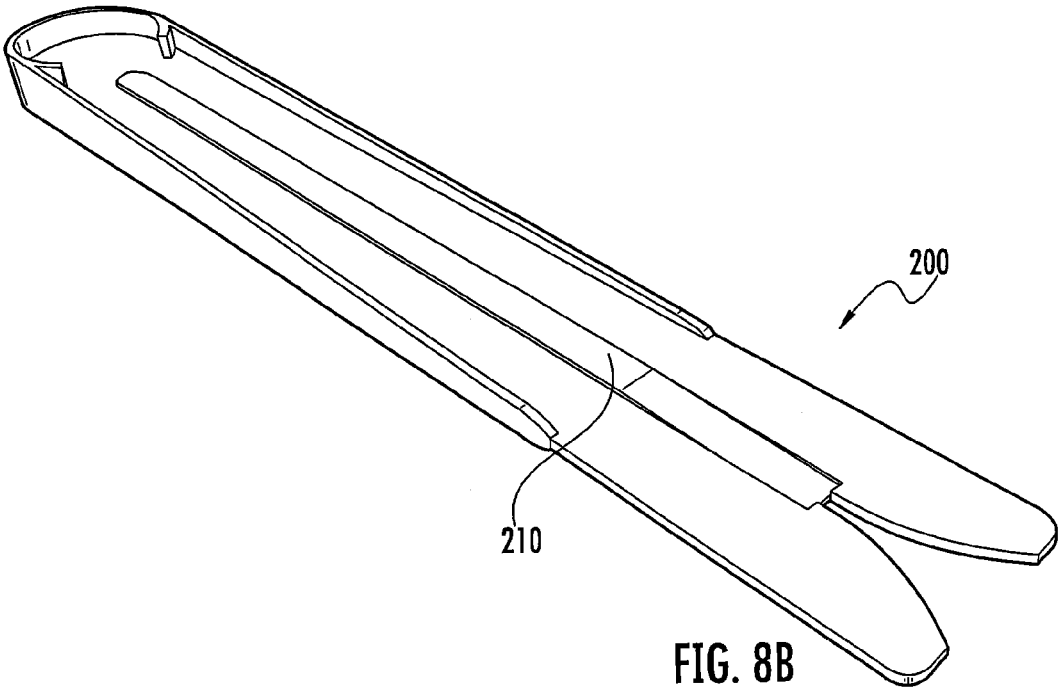
FIG. 8B is a bottom perspective view of the device of FIG. 8A.

Another embodiment of a putting practice device, designated broadly at 200, is illustrated in FIGS. 8A and 8B. The device 200 is, in essence, a combination of two devices 5 as described above with their bottom surfaces facing each other, with a rail 210 of one width on one side (e.g., one inch) and a rail 220 of a second, different width (e.g., ½ inch) on the opposite side. The incline of each "upper" surface may be adjusted to provide a desired angle for the upper surfaces when either faces upwardly. This embodiment may typically be formed of plastic, as it can be easily formed on both sides, but in a complex machining operation, metal and perhaps wood could be used. Alternative versions of the device 200 includes two bases side-by-side sharing a common portion of the fence 70, with the bases having rails of different widths, or even two devices 200 joined side-by-side, such that four differently sized rails can be presented.

An additional feature of this invention is the capability to quantify putting precision. For example, an individual may wish to know whether he/she is improving at putting, or two people may wish to play a game between themselves to see who is the better putter. Consider the following example: two people putt with the same rail inserted in the device. Person A consistently gets 50% of his putts to roll the entire length of the insert to land in the hole and the other 50% of the time the ball falls off the insert within an inch or two of the hole. Person B, on the other hand, has 50% of the putts falling off in the middle of the insert and the other 50% falling off the insert within a few inches after making contact with the ball. Clearly person A is the better putter, because person A is able to consistently hit the putt farther up the insert than person B.

Figure 9:
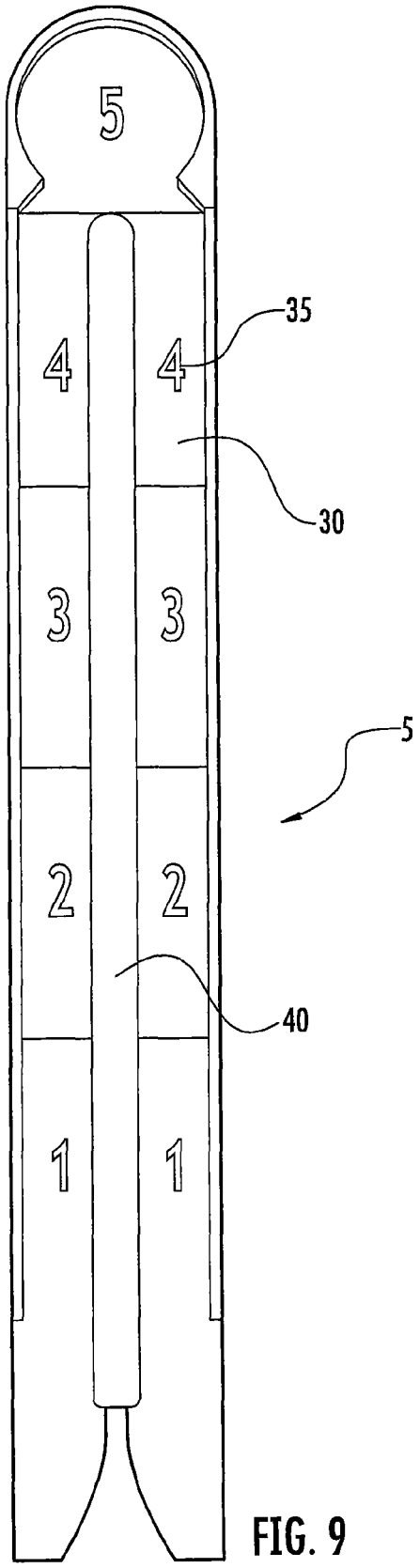
FIG. 9 is a top view of the device of FIG. 1 showing visible scorekeeping indicia.

FIG. 9 is a top view of the device 5 with scorekeeping markings 35 on the upper surface 30 to indicate various lengths of putts that travel up the rail 40 before falling off the rail 40 and landing on the upper surface 30. The markings 35 may be used to quantify the length of each putt and can be used in conjunction with the rails 40, 140, 340 to provide a system to quantify the putt precision progress for a user. In an alternative embodiment, the markings may be printed on each rail.

An example of a method to quantify putt precision is shown in Table 1 below, and herein explained. In this example, a single person is using the method to quantify his expertise level at two different points in time.

Note that column 1 of the Table 1 is defined as a list of the rows to help explain and reference said table. Line 1 of Table 1 identifies each rail 40, 140 being used to help quantify putt precision is first listed. In this scenario one person is checking for improvement in putting using two time periods addressed as Test Date 1 and Test Date 2. Exemplary calculations will be described for Test Date 1. In Line 2 a numerical value for each rail is provided, a higher number being assigned to the narrower rail 140. Referring now to the first column for rail 40, in Table 1, Line 2 the value of "1" is recorded as the difficulty level. The user would then putt a golf ball up rail 40 three times and record the number of the area (based on the markings 35) in which each ball falls off of the rail 40 onto the upper surface 30. These values are shown in Lines 3, 4 and 5 and for rail 40 are values "4", "5", and "5" respectively. The values for all three putts are totaled in Line 6 and are shown in Table 1 to be "14", which is multiplied by the rail value from Line 2 to produce the "putt-rail value" registered in Line 7 as "14".

At this point the user replaces rail 40 with a narrower rail 140, and because rail 140 is narrower and more difficult it is assigned a relative value of "3". Again three putts are taken, and as shown in Table 1 the recorded values for the three putts for rail 140 are "3", "4" and "3" which total to "10" in Line 6. Therefore the total putt-rail value is "30" shown in Line 7.

Totals for the two inserts are then added and recorded as a total of "44" for Test Date 1.

Referring again to Table 1, the procedure is repeated for Test Date 2 and a final total of "54" is recorded. The user has improved his ability to make more precise putts by reducing his putting stroke variance (he is able to consistently hit the putt higher up each rail) leading to better accuracy and reduced side spin imparted on the putt.

TABLE 1

| LINE | | TEST DATE 1 | | TEST DATE 2 | |
|---|---|---|---|---|---|
| 1 | RAIL | [40] | [140] | [40] | [140] |
| 2 | RAIL VALUE | 1 | 3 | 1 | 3 |
| 3 | PUTT 1 VALUE | 4 | 3 | 5 | 4 |
| 4 | PUTT 2 VALUE | 5 | 4 | 5 | 5 |
| 5 | PUTT 3 VALUE | 5 | 3 | 5 | 4 |
| 6 | TOTAL VALUE ALL PUTTS | 14 | 10 | 15 | 13 |
| 7 | TOTAL PUTT-RAIL VALUE | 14 | 30 | 15 | 39 |
| 8 | FINAL TOTAL | 44 | | 54 | |

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. The invention is defined by the following claims, with equivalents of the claims to be included therein.

That which is claimed is:

1. A method of practicing putting of a golf ball, comprising the steps of:

(a) providing a putting device comprising:

an elongate base with opposed first and second ends and an upper surface;

an elongate rail with a putting surface and opposed first and second ends, the rail mounted to the base such that the putting surface of the rail is positioned above and generally parallel with the upper surface of the base, and the upper surface of the base extends laterally on both sides of the rail;

a locating feature positioned adjacent the first end of the rail, the locating feature configured to provide a resting place for a golf ball;

a target area positioned near the second end of the base located adjacent the second end of the rail; and a fence mounted to at least a major portion of the periphery of the base that bounds the target area and side edges of the base;

(b) positioning a golf ball on the locating feature; and (c) putting the golf ball on the putting surface of the rail toward the target area; wherein the rail is a first rail, and further comprising the steps of:

(d) removing the first rail from the base;

(e) replacing the first rail with a second rail having a putting surface and a different width than the first rail; and (f) repeating steps (b) and (c) with the second rail.

2. The method defined in claim 1, wherein the first and second rails are co-existent as a single rail, such that the putting surface of the first rail and the putting surface of the second rail are on opposed sides of the rail.

3. The method defined in claim 1, wherein the base panel includes an open-ended tapered inlet at the first end that leads to the locating feature; and wherein step (b) comprises sweeping a golf ball with a putter into the inlet and onto the locating feature.

* * * * *